United States Patent [19]

Regan

[11] Patent Number: 4,811,427

[45] Date of Patent: Mar. 14, 1989

[54] ATHLETIC GARMENT FOR PROTECTING GENITAL AREA

[76] Inventor: Paul Regan, 9310 Sheppard Avenue East, P.O. Box 26, Agincourt, Ontario, Canada, M1S 3B4

[21] Appl. No.: 92,524

[22] Filed: Sep. 3, 1987

[51] Int. Cl.[4] ..... A41D 13/00; A41C 1/00

[52] U.S. Cl. ..... 2/2; 2/227; 2/404; 2/DIG. 6

[58] Field of Search ..... 2/2, 401, 403, 404, 2/405, 240, 227, 234, 250, DIG. 6

[56] References Cited

U.S. PATENT DOCUMENTS

| | | | |
|---|---|---|---|
| 2,599,769 | 6/1952 | MacRae et al. | 2/404 X |
| 2,983,924 | 5/1961 | Cohen et al. | 2/404 X |
| 3,128,476 | 4/1964 | Lash | 2/DIG. 6 |
| 3,501,774 | 3/1970 | Norman | 2/240 X |
| 3,670,339 | 6/1972 | Cooper et al. | 2/240 X |
| 4,014,044 | 3/1977 | Figueroa et al. | 2/404 X |
| 4,035,844 | 7/1977 | Atack et al. | 2/227 X |
| 4,091,466 | 5/1978 | Kearn | 2/227 X |
| 4,389,733 | 6/1983 | Boykins | 2/2 |

*Primary Examiner*—Louis K. Rimrodt
*Attorney, Agent, or Firm*—Sim & McBurney

[57] ABSTRACT

An athletic garment particularly suitable for hockey players protects the genital area of the wearer. The garment comprises a waistband which is supported at the wearer's waist elastically and with a drawstring. An inner pant and an outer pant are attached the waistband. The inner pant has a rise so selected that its crotch portion engages and supports the genital area of the wearer. The outer pant has a pocket adjacent its crotch portion which receives a genital protector. The pocket is positioned to overlay the genital area when the waistband is maintained at the wearer's waist thereby ensuring proper protection. The outer pant has a larger rise than the inner pant so that the pocket is normally spaced from the wearer's genital area, providing greater comfort and enhanced freedom of movement. Hook-type Velcro TM fasteners are positioned on the front and back of each pant leg associated with the outer pant and serve to support hockey stockings.

12 Claims, 2 Drawing Sheets

ATHLETIC GARMENT FOR PROTECTING GENITAL AREA

FIELD OF THE INVENTION

The invention relates primarily to an athletic garment intended to provide protection for the genital area of a wearer, and, in a preferred form, provides light-weight hockey shorts which simultaneously provide genital protection, support for hockey leggings, and enhanced freedom of skating movement and wearer comfort.

DESCRIPTION OF THE PRIOR ART

The invention has particularly advantageous, though not exclusive, application to hockey garments.

According to present practice, a hockey player normally wears a conventional athletic support. Such a support is basically an elasticized undergarment which is worn immediately against the skin and which serves to support and raise the genital area to provide a measure of protection against injury. A genital protector, commonly referred to as a "cup", is normally inserted into the athletic support which may be formed with a pocket appropriate for such purposes. The cup is usually a hard convex-shaped device intended to absorb the impact of a hockey puck or stick.

A garter with appropriate garter-type fasteners is normally worn over the athletic support and cup. The garter serves to support the stockings commonly worn by a hockey player during play. A hockey pant with short pant legs is commonly worn over the garter and may be provided with appropriate hip and thigh protectors.

This basic arrangement comprising an elasticized athletic support containing a cup and a garter-type stocking support has been common practice for many decades. It is still today the principal arrangement used to protect hockey players against groin injuries and to support their stockings.

There are a number of shortcomings associated with such conventional practices. Anyone who has worn an athletic support and cup can attest to the discomfort which these can occasion. They tend to restrict a hockey player's freedom of movement and make him extremely conscious of the presence of the support and protector. Additionally, the garter-type stocking supports are cumbersome, add an additional component to the number of garments which must be purchased and worn by a player, and can be a source of embarrassment to young players.

It would be desirable to provide an alternative form of hockey garment which simultaneously provides proper support and protection of the genital area and relatively enhanced freedom of movement and comfort. In connection with such a garment, it would also be desirable to provide a simpler means for supporting hocking leggings or stockings. It would additionally be desirable that such a garment lend itself to and be appropriate for fabrication from light-weight materials so that the garment does not add significantly to the weight of garments and protective devices otherwise worn by a hockey player.

BRIEF SUMMARY OF THE INVENTION

In one aspect, the invention provides an athletic garment for use in protecting the genital area of the wearer. The garment comprises a waistband and support means for maintaining the waistband at the wearer's waist. The support means may comprise, for example, elastic means which normally tend to contract the waistband, a drawstring, or a clasp or button arrangement which draws the waistband sufficiently tight about the wearer's waist as to tend to prevent relative dropping of the waistband.

The garment comprises both an inner pant and an outer pant. Both the inner and outer pants are supported from the waistband by stitching directly thereto or any other appropriate manner. The inner pant has a rise so selected that a crotch portion associated with the inner pant normally engages and supports the genital area of the wearer when the waistband is maintained at the wearer's waist. A pocket is formed adjacent to the crotch portion associated with the outer pant, which pocket is adapted to receive a genital protector. The pocket is normally positioned forwardly of and overlays the genital area of the wearer whenever the waistband is maintained at the wearer's waist. The outer pant has a rise so selected that the pocket and the contained genital protector are normally spaced from the crotch portion of the inner pant when the waistband is maintained at the wearer's waist.

The different rises between the inner and outer pants permits the pocket and the contained genital protector to move to a limited degree relative to the wearer's body. Accordingly, the wearer is provided with protection for his genital area and also an enhanced freedom of movement and comfort. The arrangement also alerts the wearer as to whether his genital protector is properly positioned, as described more fully below.

When used as a hockey garment, the outer pant may have a pair of short pant legs each of which has attached thereto a pair of Velcro TM fasteners of the type formed with a multiplicity of filament-like hooks. These fasteners are preferably spaced-apart, one fastener of each pair being located at a front portion of the associated pant leg, the other being located at a back portion of the associated pant leg. Conventional hockey leggings or stockings can be conveniently hooked to the fasteners, which if spaced-apart and attached to front and back portions of the pant legs, permit considerable freedom of movement for the hockey player. A conventional garter is consequently eliminated.

The terms "inner" and "outer pant" should not be construed as suggesting that the outer pant will necessarily constitute a garment intended for external wear. In practice, the inner and outer pants are preferably formed of light-weight fabrics and may both be worn beneath athletic garments specifically intended as outer wear, such as conventional hockey shorts. Also, in interpreting the functions and features to be provided by a garment constructed according to the invention, and in interpreting the appended claims, it should be understood that such garments will be made to accommodate an individual of particular size, as is common practice with more conventional garments.

Other inventive features will be apparent from the description of preferred embodiment below and will be more specifically identified in the appended claims.

DESCRIPTION OF THE DRAWINGS

The invention will be better understood with reference to drawings in which.

DESCRIPTION OF PREFERRED EMBODIMENT

Figure 1:
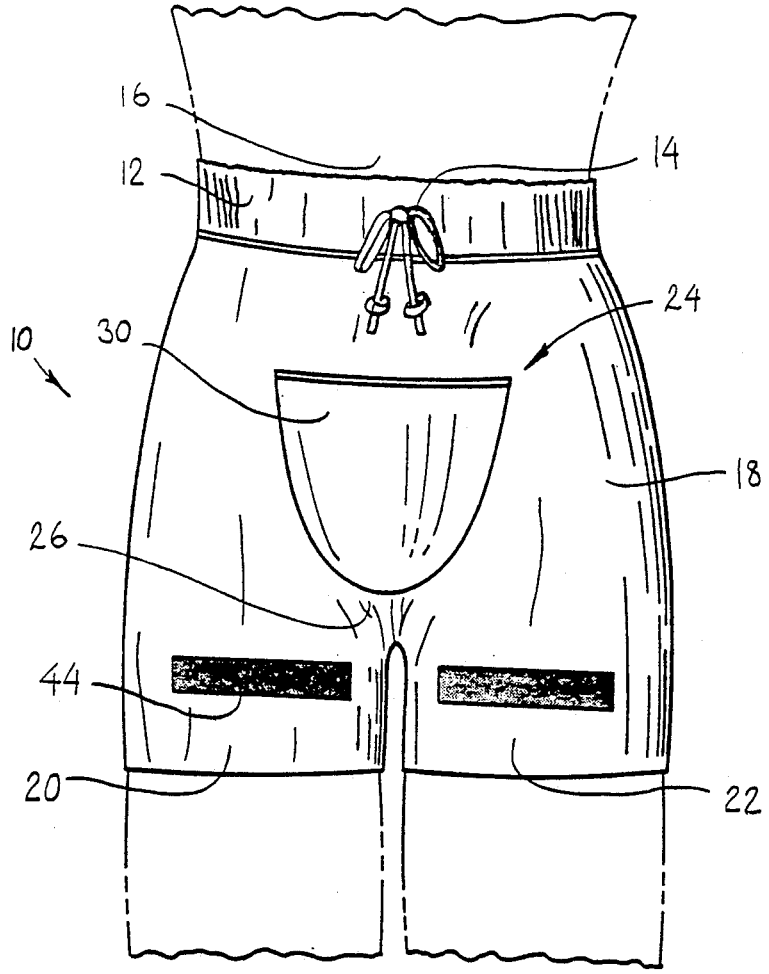
FIG. 1 is an elevational view of a hockey garment constructed according to the present invention, shown supported from the waist of a wearer.

FIG. 1 shows the exterior of a hockey garment 10 constructed according to the invention. The garment 10 may be seen to comprise a waistband 12 which is elasticized and in addition comprises a drawstring 14, both of which serve to contact the waistband 12 about the waist 16 of a wearer. For purposes of the invention, it is important that the waistband 12 be properly maintained at the waist 16 to ensure proper protection of the wearer.

The hockey garment 10 comprises an outer pant 18 having a pair of short pant legs 20, 22. A pocket 24 is formed on the exterior of the outer pant 18 adjacent a crotch portion 26 associated with the outer pant 18. The pocket 24 is positioned forwardly of and overlays the genital area of the wearer when the waistband 12 is maintained at the wearer's waist 16. The pocket 24 is shaped to retain a protective cup 28 (illustrated in FIG. 2) of predetermined size and comprises a movable flap 30 which can be opened either to receive or remove the cup 28. The flap 30 is releasably secured with complementary Velcro TM fasteners 32, 34 to the body of the outer pant 18. One fastener 32 formed with a multiplicity of filament-like hooks is attached to the inside of the flap 30. The other fastener 34 which is formed with a multiplicity of filament-like loops is attached to the body of the outer pant 18 in the interior of the pocket 24.

The hockey garment 10 comprises an inner pant 36 located within the outer pant 18. An upper circumferential portion 38 of the inner pant 36 is sandwiched between inner and outer portions 40, 42 of the waistband 12 and stitched thereto fully around the circumference of the waistband 12. The inner pant 36 is consequently supported from the waistband 12 when the garment 10 is worn.

The inner pant 36 has a predetermined rise. For purposes of the present specification, the term "rise" should be understood in the conventional sense as being a measure of the distance between the bottom of the crotch and the top of the waistband associated with and supported the pant. This rise is so selected that an inner crotch portion 43 associated with the inner pant 36 engages and supports the genital area of the wearer while the waistband 12 is maintained at the wearer's waist 16.

The outer pant 18 has a rise which is greater than that of the inner pant 36 by a preselected amount. Accordingly, the pocket 24 and contained cup 28 associated with the outer pant 18 will normally be spaced from the crotch portion 43 of the inner pant 36 and the wearer's genital area. Since the cup 28 is externally supported, and can move relative to the wearer, there is significantly increased comfort to the wearer. Both freedom of movement and comfort will be enhanced by increasing the difference between the inner and outer rises.

It will be apparent that the cup 28 essentially floats relative to the genital area. In prior practices, an elasticized athletic support and cup would be positioned immediately against the skin and over the genital area of the athlete. There is little relative movement of the athletic support and associated cup relative to the wearer's body in such a prior practice, and accordingly the wearer is guaranteed a measure of protection against injury, although no significant measure of comfort. Since according to the present invention the genital protector will float to a certain degree relative to the wearer's genital area and is not directly attached to the wearer's genital area, it is important that the wearer have some indication that the genital protector is properly positioned. In particular, the most significant displacement of the cup 28 tending to reduce protection of the genital area would involve a downward movement with the outer pant 18. Since both the outer and inner pants 18, 36 are supported from the waistband 12, any downward movement of the waistband 12 that must accompany such a downward movement of the cup 28 and outer pant 18 is manifested as a loosening of the inner pant 36 from the wearer's body. He is accordingly alerted to the fact that the genital protector is no longer properly positioned, and can take steps to raise the waistband 12 and tighten the associated drawstring 14.

Figure 2:
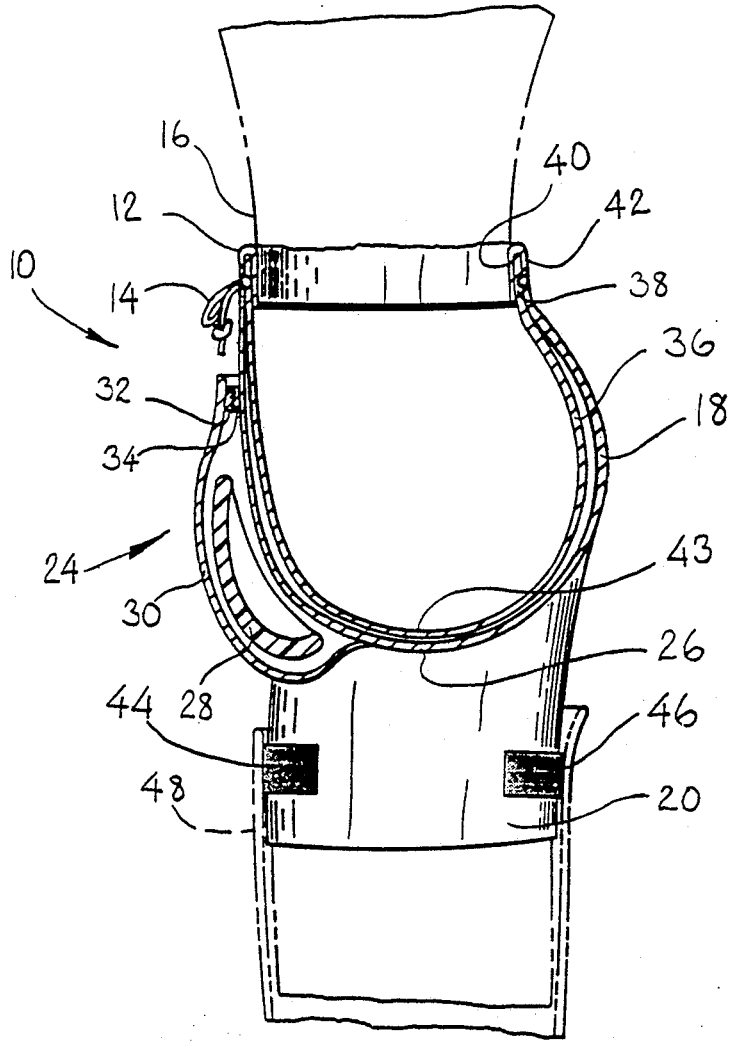
FIG. 2 is a cross-sectional view in a vertical plane extending from front to back through the crotch region of the garment.

Each pant leg associated with the outer pant 18 carries Velcro TM fasteners. These fasteners are of the male type, comprising a dense mass of filament-like hooks. In FIG. 2, typical fasteners 44, 46 associated with the right pant leg 20 have been illustrated and specifically identified. These fasteners 44, 46 may be seen to be spaced-apart circumferentially, one fastener 44 being positioned at a front portion of the pant leg 20 on its exterior surface, the other fastener 46 being positioned on a back portion of the pant leg 20, once again on the exterior surface. A hockey legging or stocking 48 (shown in stippled outline in FIG. 2) would normally be formed of a wool or a comparable material and is drawn up over the pant leg 20. The filament-like hooks of the two fasteners 44, 46 fasten to the woollen material and support the stocking 48 directly from the exterior of the pant leg 20. Accordingly, conventional garter-type fasteners are eliminated, and hockey stockings may be very quickly and reliably supported.

The stocking fasteners are preferably spaced-apart and positioned on the front and back on each pant leg. If formed as a single circumferential fastener or equivalent structure mounted on the front, back and sides of the pant legs 20, 22, skating movement tends to be impeded. Basically, the player will sense a tugging from his stockings as he skates, particularly when turning. Positioning the fasteners 44, 46 as described at the front and back of the pant leg 20 ensures greater freedom of movement The outer and inner pants 18, 36 may be formed of comparatively light fabrics. Accordingly, protection for the genital area of the hockey player and support for his leggings can be provided without significantly adding to the weight of the outer garments and the protective gear otherwise worn. An additional heavier pair of hockey shorts with optional thigh or hip protectors would typically be worn over the outer and inner pants 18, 36.

It will be appreciated that a particular embodiment of the invention has been described and that modifications may be made therein without departing from the spirit of the invention or the scope of the appended claims.

I claim:

1. An athletic garment for use in protecting the genital area of a wearer, comprising:

a waistband;

support means associated with the waistband for maintaining the waistband at the waist of the wearer;

an outer pant supported from the waistband, the outer pant having an outer crotch portion, the outer crotch portion having a pocket shaped to receive and releasably retain a genital protector, the pocket being positioned forwardly of the genital area of the wearer when the waistband is maintained at the wearer's waist;

an inner pant located within the outer pant and supported from the waistband, the inner pant having an inner crotch portion and a predetermined rise so selected that the inner crotch portion engages the genital area of the wearer when the waistband is maintained at the waist of the wearer, the inner pant being so supported from the waistband that downward displacement of the genital protector with the outer pant relative to the inner pant causes a losening of the inner pant from the wearer's body;

the outer pant having a rise greater than the rise of the inner pant such that the genital protector is spaced from and movable relative to the inner crotch portion when the waistband is maintained at the wearer's waist, the difference between the rises of the inner and outer pants being selected such that the genital protector remains in a protective position overlaying the genital area whenever the waistband is maintained at the wearer's waist.

2. An athletic garment as claimed in claim 1 adapted to support stockings, in which:

the outer pant comprises a pair of pant legs;

each pant leg has attached thereto a pair of spaced-apart fasteners formed with a multiplicty of filament-like hooks, one of each pair of fasteners being located at a front portion of the associated pant leg and the other of each pair of fasteners being located at a back portion of the associated pant leg.

3. An athletic garment as claimed in claim 2 in which each of the fasteners is located on an external surface of the associated pant leg.

4. An athletic garment as claimed in claim 1 in which the support means comprise a draw-string.

5. An athletic garment as claimed in claim 1 in which the support means comprise an elastic means which tends to contract the waistband.

6. An athletic garment for protecting the genital area of a wearer, comprising:

a waistband;

support means associated with the waistband for maintaining the waistband at the waist of the wearer;

an outer pant supported from the waistband, the outer pant having an outer crotch portion, the outer crotch portion carrying a genital protector positioned forwardly of the genital area of the wearer when the waistband is maintained at the wearer's waist;

an inner pant located within the outer pant and supported from the waistband, the inner pant having an inner crotch portion and a predetermined rise so selected that the inner crotch portion engages the genital area of the wearer when the waistband is maintained at the waist of the wearer, the inner pant being supported from the waistband such that any downward displacement of the genital protector with the outer pant relative to the inner pant causes a loosening of the inner pant from the wearer's body;

the outer pant having a rise greater than the rise of the inner pant such that the genital protector is spaced from and movable relative to the inner crotch portion when the waistband is maintained at the wearer's waist, the difference between the rises of the inner and outer pants being selected such that the genital protector remains in a protective position overlaying the genital area whenever the waistband is maintained at the wearer's waist.

7. An athletic garment as claimed in claim 6 in which the outer crotch portion has a pocket comprising a movable flap portion, a first connector attached to the movable flap portion, a second connector attached to the rest of the outer pant and positioned for engagement with the first connector, one of the connectors being formed with a multiplicity of filament-like hooks, the other of the connectors being formed with a multiplicity of loops dimensioned to engage and retain the hooks.

8. An athletic garment as claimed in claim 6 adapted to support stockings, in which:

the outer pant comprises a pair of pant legs;

each pant leg has attached thereto a pair of spaced-apart fasteners formed with a multiplicity of filament-like hooks, one of each pair of fasteners being located at a front portion of the associated pant leg and the other of each pair of fasteners being located at a back portion of the associated pant leg.

9. An athletic garment as claimed in claim 8 in which each of the fasteners is located on an external surface of the associated pant leg.

10. An athletic garment as claimed in claim 6 in which the support means comprise a draw-string.

11. An athletic garment as claimed in claim 6 in which the support means comprise an elastic means which tends to contract the waistband.

12. A hockey garment comprising:

a waistband;

support means associated with the waistband for maintaining the waistband at the waist of a wearer;

an outer pant supported from the waistband, the outer pant having an outer crotch portion and a pair of pant legs, the outer crotch portion having a pocket shaped to receive and releasably retain a genital protector, the pocket positioned forwardly of the genital area of the wearer when the waistband is maintained at the wearer's waist;

an inner pant located within the outer pant and supported from the waistband, the inner pant having an inner crotch portion and a predetermined rise so selected that the inner crotch portion engages the genital area of the wearer when the waistband is maintained at the waist of the wearer, the inner pant being supported from the waistband such that any downward displacement of the genital protector with the outer pant relative to the inner pant causes a loosening of the inner pant from the wearer's body;

the outer pant having a rise greater than the rise of the inner pant such that the genital protector is spaced from and movable relative to the inner crotch portion when the waistband is maintained at the wearer's waist, the difference between the rises of the inner and outer pants being selected such that the genital protector remains ina protective position overlaying the genital area whenever the waistband is maintained at the wearer's waist;

each pant leg having attached thereto a fastener formed with a multiplicity of filament-like hooks whereby a stocking can be secured by means of the fasteners to each pant leg.

* * * * *